US011079780B2

(12) United States Patent
Mathad et al.

(10) Patent No.: US 11,079,780 B2
(45) **Date of Patent: *Aug. 3, 2021**

(54) SUPPLY VOLTAGE REGULATOR

(71) Applicant: Texas Instruments Incorporated, Dallas, TX (US)

(72) Inventors: Jayateerth Pandurang Mathad, Bangalore (IN); Rajat Chauhan, Bangalore (IN)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/677,284

(22) Filed: Nov. 7, 2019

(65) Prior Publication Data

US 2020/0073423 A1 Mar. 5, 2020

Related U.S. Application Data

(63) Continuation of application No. 16/216,836, filed on Dec. 11, 2018, now Pat. No. 10,503,185.

(30) Foreign Application Priority Data

Jul. 12, 2018 (IN) ..... 201841026026

(51) Int. Cl.

| | |
|---|---|
| ***G05F 1/571*** | (2006.01) |
| ***G05F 3/24*** | (2006.01) |
| ***G05F 1/59*** | (2006.01) |

(52) U.S. Cl.

CPC ..... *G05F 1/571* (2013.01); *G05F 1/59* (2013.01); *G05F 3/24* (2013.01)

(58) Field of Classification Search

CPC ..... G05F 1/571; G05F 1/569; G05F 1/575; G05F 1/465; G05F 1/468; G05F 3/24; G05F 1/59; G05F 1/595; G05F 1/618

See application file for complete search history.

(56) References Cited

U.S. PATENT DOCUMENTS 7,312,598 B1 12/2007 Huang
2008/0116862 A1* 5/2008 Yang ..... G05F 1/575 323/269

(Continued)

OTHER PUBLICATIONS

Texas Instruments, "TPS383x 150-nA, Ultralow Power, Supply Voltage Monitor," Jun. 2012, Revised Jul. 2015, 34 pages.

*Primary Examiner* — Harry R Behm
(74) *Attorney, Agent, or Firm* — Michelle F. Murray; Charles A. Brill; Frank D. Cimino

(57) ABSTRACT

A circuit comprising a NMOS having a gate coupled to a first node and a source terminal coupled to a second node, a second NMOS having a gate coupled to the second node and a source terminal coupled to an output node, a PMOS having a gate coupled to a third node, a drain terminal coupled to a fourth node, and a source terminal coupled to a fifth node, and a second PMOS having a gate coupled to the fourth node, a drain terminal coupled to the output node, and a source terminal coupled to the fifth node. The circuit also includes a voltage protection sub-circuit coupled to the first node, a fast turn-off sub-circuit coupled to the output node, a fast turn-on sub-circuit coupled to the third and fourth nodes, and a node initialization sub-circuit coupled to the first, second, and fourth nodes and the fast turn-on sub-circuit.

30 Claims, 7 Drawing Sheets

(56) References Cited

U.S. PATENT DOCUMENTS

| | | | | |
|---|---|---|---|---|
| 2008/0116866 | A1 | 5/2008 | Tsai | |
| 2013/0038314 | A1* | 2/2013 | Nakashima | H02M 3/158 323/304 |
| 2014/0266088 | A1* | 9/2014 | Makino | G05F 1/575 323/266 |
| 2016/0033984 | A1 | 2/2016 | Lee | |
| 2019/0036444 | A1 | 1/2019 | Wan et al. | |
| 2019/0079550 | A1 | 3/2019 | Greene et al. | |

* cited by examiner

SUPPLY VOLTAGE REGULATOR

CROSS-REFERENCE TO RELATED APPLICATIONS

Under 35 U.S.C. § 120, this continuation application claims benefits of and priority to U.S. patent application Ser. No. 16/216,836, filed on Dec. 11, 2018, which claims priority to Indian Provisional Patent Application No. 201841026026, which was filed Jul. 12, 2018, is titled "A nA Iq, SCHEME FOR SUPPLY VOLTAGE SUB-REGULATION WITH FAST RESPONSE, HV PROTECTION AND ROBUST STARTUP." The above referenced applications are hereby incorporated herein by reference in its entirety.

SUMMARY

At least some aspects of the present disclosure provide for a circuit. In some examples, the circuit comprises a control sub-circuit, a voltage protection sub-circuit, a fast turn-off sub-circuit, a fast turn-on sub-circuit, and a node initialization sub-circuit. The control sub-circuit comprises a first n-type metal oxide semiconductor field effect transistor (MOSFET) (NMOS) having a gate terminal coupled to a first node, a drain terminal, and a source terminal coupled to a second node, a second NMOS having a gate terminal coupled to the second node, a drain terminal, and a source terminal coupled to an output node, a first p-type MOSFET (PMOS) having a gate terminal coupled to a third node, a drain terminal coupled to a fourth node, and a source terminal coupled to a fifth node, and a second PMOS having a gate terminal coupled to the fourth node, a drain terminal coupled to the output node, and a source terminal coupled to the fifth node. The control sub-circuit further comprises a diode stack coupled between the first node and a sixth node, a third NMOS having a gate terminal coupled to the sixth node; a drain terminal coupled to a seventh node, and a source terminal, and a third PMOS having a gate terminal, a drain terminal coupled to the seventh node, and a source terminal coupled to the third node. The voltage protection sub-circuit is coupled to the first node. The fast turn-off sub-circuit is coupled to the output node. The fast turn-on sub-circuit is coupled to the third node and the fourth node. The node initialization sub-circuit is coupled to the first node, the second node, the fourth node, and the fast turn-on sub-circuit.

Other aspects of the present disclosure provide for a circuit. In some examples, the circuit comprises a first NMOS having a gate terminal coupled to a first node, a drain terminal, and a source terminal coupled to a second node, a second NMOS having a gate terminal coupled to the second node, a drain terminal, and a source terminal coupled to an output node, a first PMOS having a gate terminal coupled to a third node, a drain terminal coupled to a fourth node, and a source terminal coupled to a fifth node, a second PMOS having a gate terminal coupled to the fourth node, a drain terminal coupled to the output node, and a source terminal coupled to the fifth node, a diode stack coupled between the first node and a sixth node, a third NMOS having a gate terminal coupled to the sixth node; a drain terminal coupled to a seventh node, and a source terminal, and a third PMOS having a gate terminal, a drain terminal coupled to the seventh node, and a source terminal coupled to the third node. The circuit also comprises a fourth PMOS having a gate terminal coupled to an eighth node, a drain terminal coupled to the eighth node, and a source terminal coupled to a ninth node, a fifth PMOS having a gate terminal coupled to the eighth node, a drain terminal coupled to the fourth node, and a source terminal coupled to the ninth node, a first capacitor coupled between the ninth node and a tenth node, a first current source coupled between the tenth node and an eleventh node, a first diode and a second diode coupled in series between the tenth node and the eleventh node, a fourth NMOS having a gate terminal coupled to the tenth node, a drain terminal coupled to the eighth node, and a source terminal coupled to the eleventh node, a fifth NMOS having a gate terminal coupled to the tenth node, a drain terminal coupled to the second node, and a source terminal coupled to the eleventh node, a sixth NMOS having a gate terminal coupled to the tenth node, a drain terminal coupled to the first node, and a source terminal coupled to the eleventh node, and a seventh NMOS having a gate terminal coupled to the tenth node, a drain terminal coupled to a nineteenth node, and a source terminal coupled to the eleventh node. The circuit also comprises an eighth NMOS having a gate terminal coupled to a twelfth node, a drain terminal coupled to the fifth node, and a source terminal coupled to a thirteenth node, a ninth NMOS having a gate terminal coupled to the thirteenth node, a source terminal, and a drain terminal coupled to the fifth node, a tenth NMOS having a drain terminal coupled to the source terminal of the ninth NMOS, a gate terminal coupled to the first node, and a source terminal coupled to a sixteenth node, an eleventh NMOS having a gate terminal coupled to the thirteenth node, a drain terminal coupled to the fifth node, and a source terminal coupled to the drain terminal of the first NMOS, a twelfth NMOS having a gate terminal coupled to the thirteenth node, a drain terminal coupled to the fifth node, and a source terminal coupled to the drain terminal of the second NMOS, a second current source coupled between the fifth node and the twelfth node, a Zener diode having an anode coupled to the twelfth node and a cathode coupled to a fifteenth node, and a third current source coupled between the thirteenth node and the fifteenth node. The circuit also comprises a thirteenth NMOS having a gate terminal coupled to the output node, a drain terminal coupled to the output node, and a source terminal, a sixth PMOS having a gate terminal coupled to a twenty-second node, a drain terminal coupled to a fourteenth node, and a source terminal coupled to the source terminal of the thirteenth NMOS, a fourteenth NMOS having a gate terminal coupled to the fourteenth node, a drain terminal coupled to the output node, and a source terminal coupled to the fifteenth node, a fifteenth NMOS having a gate terminal coupled to the fourteenth node, a drain terminal coupled to the seventh node, and a source terminal coupled to the fifteenth node, and a fourth current source coupled between the fourteenth node and the fifteenth node. The circuit also comprises a seventh PMOS having a gate terminal coupled to a seventeenth node, a drain terminal coupled to the third node, and a source terminal coupled to the fifth node, an eighth PMOS having a gate terminal coupled to the seventeenth node, a drain terminal coupled to the seventeenth node, and a source terminal coupled to the fifth node, a sixteenth NMOS having a gate terminal coupled to an eighteenth node, a drain terminal coupled to the fourth node, and a source terminal coupled to the fifteenth node, a seventeenth NMOS having a gate terminal coupled to the eighteenth node, a drain terminal coupled to the seventeenth node, and a source terminal coupled to the fifteenth node, a second capacitor coupled between the eighteenth node and the nineteenth node, a fifth current source coupled between the fifth node and the nineteenth node, a sixth current source coupled between the eighteenth node and the fifteenth node, a third diode and a fourth diode coupled in series between the nineteenth node and the fifteenth node; and an eighteenth NMOS having a gate terminal coupled to a sixth node, a drain terminal coupled to the nineteenth node, and a source terminal coupled to the fifteenth node.

Other aspects of the present disclosure provide for a system. In some examples, the system includes a supply voltage regulator (SVR) circuit that comprises a control sub-circuit, a voltage protection sub-circuit, a fast turn-off sub-circuit, a fast turn-on sub-circuit, and a node initialization sub-circuit. The control sub-circuit comprises a first NMOS having a gate terminal coupled to a first node, a drain terminal, and a source terminal coupled to a second node, a second NMOS having a gate terminal coupled to the second node, a drain terminal, and a source terminal coupled to an output node, a first PMOS having a gate terminal coupled to a third node, a drain terminal coupled to a fourth node, and a source terminal coupled to a fifth node, and a second PMOS having a gate terminal coupled to the fourth node, a drain terminal coupled to the output node, and a source terminal coupled to the fifth node. The control sub-circuit further comprises a diode stack coupled between the first node and a sixth node, a third NMOS having a gate terminal coupled to the sixth node; a drain terminal coupled to a seventh node, and a source terminal, and a third PMOS having a gate terminal, a drain terminal coupled to the seventh node, and a source terminal coupled to the third node. The voltage protection sub-circuit is coupled to the first node. The fast turn-off sub-circuit is coupled to the output node. The fast turn-on sub-circuit is coupled to the third node and the fourth node. The node initialization sub-circuit is coupled to the first node, the second node, the fourth node, and the fast turn-on sub-circuit. The system also includes a battery coupled to the fifth node and a load coupled to the output node.

Other aspects of the present disclosure provide for a circuit. In some examples, the circuit includes a control sub-circuit, a voltage protection sub-circuit, a fast turn-off sub-circuit, a fast turn-on sub circuit, and a node initialization sub-circuit. The voltage protection sub-circuit is configured to protect the control sub-circuit from a voltage input signal that exceeds a tolerance of the control sub-circuit. The fast turn-off sub-circuit is configured to turn off at least a portion of the control sub-circuit more rapidly than in the absence of the fast turn-off sub-circuit. The fast turn-on sub-circuit is configured to turn on at least the portion of the control sub-circuit more rapidly than in the absence of the fast turn-on sub-circuit. The node initialization sub-circuit is configured to initialize a plurality of nodes of the circuit.

BRIEF DESCRIPTION OF THE DRAWINGS

For a detailed description of various examples, reference will now be made to the accompanying drawings in which.

DETAILED DESCRIPTION

Figure 1:
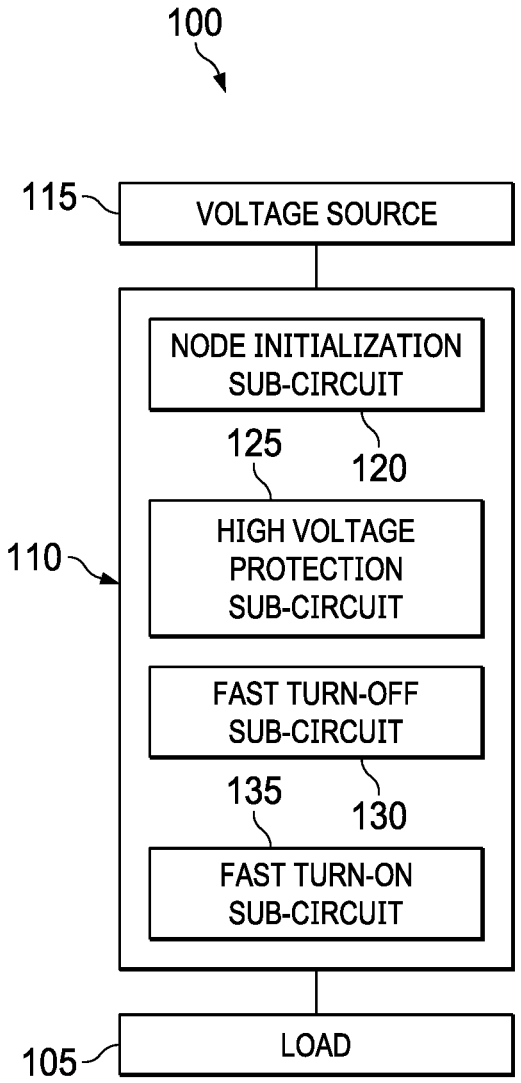
FIG. 1 shows a block diagram of an illustrative system in accordance with various examples.

A supply voltage regulator (SVR) is a circuit that, among other functions, provides a regulated voltage to a load to protect against over-voltage (OV) conditions or other irregularities in the regulated voltage, such as under-voltage (UV) conditions, that have the potential to detrimentally impact operation of the load. Because any current consumed by the SVR circuit is in addition to current consumed by the load, operation of the SVR circuit can decrease the battery life of a device that includes the SVR circuit and is powered by a battery and/or increase power consumption of the device. Therefore, user experience is diminished due to the reduced battery life of the device and/or cost of use or operation of the device is increased. For at least this reason, it is sometimes beneficial to minimize an amount of current consumed by the SVR circuit. At the same time, it is sometimes beneficial to minimize a response time of the SVR circuit so that the load more quickly receives the regulated voltage and can begin its own operations. It at least some examples, it can be beneficial for an SVR circuit to have a quiescent current (Iq), or current consumed by the SVR circuit in no-load, non-switching operation, of less than about 60 nano-Amps (nA) and a response time of less than about 200 microseconds (μs). However, operational characteristics of the SVR circuit cause the low quiescent current and fast response time criteria to be contradictory. For example, to rapidly turn a transistor on (e.g., cause the transistor to conduct current between its source and drain terminals), a large current is provided to a gate terminal of the transistor to rapidly push the transistor into a desire operating range. However, the large current provided to the gate terminal of the transistor increases the Iq of the SVR circuit, resulting in a SVR circuit with a fast response time but without a low Iq. Conversely, by providing a small current to the gate terminal of the transistor, the transistor slowly moves to the desired operating range, resulting in a SVR circuit with a low Iq but a slow response time. Additionally, certain examples of SVR circuits include desired operational characteristics in addition to low Iq and fast response time, such as, for example, robust start-up (e.g., monotonous start-up that does not result in false power on reset (PoR) activation), high voltage input protection, and response to fast transient changes (e.g., such as changes of 1 volt (V) per μs). At least some of these additional desired operational characteristics can similarly be contradictory to one another and/or contradictory to a low and fast response time.

At least some aspects of the present disclosure provide for a SVR circuit architecture having a low Iq (e.g., less than about 60 nA), a fast response time (e.g., less than about 200 μs and/or less than about 100 μs) for both start-up and turn-off, node initialization, and high-voltage protection. In at least some examples, the SVR circuit includes a plurality of sub-circuits that each provides a certain operational capability to the SVR circuit. For example, a node initialization sub-circuit at least partially provides for initiating a node of the SVR circuit during start-up of the SVR circuit. A high-voltage protection sub-circuit at least partially provides for protection of components of the SVR circuit from high voltage (e.g., protecting transistor gate oxides from high voltages that can cause damage to the transistors). A fast turn-off sub-circuit at least partially provides for fast turn-off of the SVR circuit in response to line transients. A fast start-up sub-circuit at least partially provides for fast start-up and turn-on of the SVR circuit in response to line transients. In some examples, one or more of the sub-circuits are omitted from the SVR circuit according to desired operational capabilities of the SVR circuit, desired operational characteristics of the SVR circuit, or any other suitable criteria. In some examples, the various sub-circuits of the SVR circuit are implemented in a same electrical chip, within a same electrical chip package, on a same semiconductor die, etc. In other examples, at least some of the various sub-circuits and/or components of the various sub-circuits are implemented in a plurality of electrical chips, a plurality of electrical chip packages, and/or on a plurality of semiconductor dies configured to couple together to operate as the SVR circuit.

Turning now to FIG. 1, a block diagram of an illustrative system 100 is shown. In at least some examples, the system 100 is an electronic device having one or more components that collectively comprise a load 105, a SVR circuit 110, and a voltage source 115. For example, in various implementations the system 100 is a consumer electronic device (e.g., a smart phone, a tablet, a computer, an Internet of Things (IoT) device, etc.) powered at least some of the time by a battery (e.g., such that the battery is the voltage source 115 and circuitry of the consumer electronic device is the load 105). In at least some examples, the voltage source 115 is a battery, while in other examples the voltage source 115 is any suitable voltage source, such as a direct current (DC) voltage obtained via a coupling to voltage mains. In some examples, the SVR circuit 110 includes a node initialization sub-circuit 120, a high voltage protection sub-circuit 125, a fast turn-off sub-circuit 130, and a fast start-up sub-circuit 135, each communicatively coupled together to collectively operate at least partially as the SVR circuit 110.

In at least one example, the SVR circuit 110 includes a n-type metal oxide semiconductor field effect transistor (MOSFET) (NMOS) path (not shown but passing from node 278 through the NMOS 205 and node 279 to the NMOS 206) and a p-type MOSFET (PMOS) path (not shown but passing from node 278 through the diode stack to node 282, NMOS 216, node 272, PMOS 215, and node 275 to the PMOS 215). When the voltage source 115 has an input voltage (Vin) that is high (e.g., greater than a desired output voltage (Vout) of the SVR circuit 110), current flows through the SVR circuit 110 from the voltage source 115 to the load 105 based on control performed through the NMOS path of the SVR circuit 110. When Vin is low (e.g., less than the desired Vout of the SVR circuit 110), current flows through the SVR circuit 110 from the voltage source 115 to the load 105 based on control performed through the PMOS path of the SVR circuit 110. In at least some examples, the NMOS path includes one or more NMOS devices (not shown) and the PMOS path includes one or more PMOS devices (not shown).

At least some of the NMOS devices of the NMOS path, the PMOS devices of the PMOS path, and/or devices of any of the node initialization sub-circuit 120, the high voltage protection sub-circuit 125, the fast turn-off sub-circuit 130, and/or the fast start-up sub-circuit 135 may be sensitive to high voltages. For example, at least some of the devices may be transistors having gate oxide rated at about 5 V. In some examples of the system 100, Vin can reach values greater than 5 V, such as 10 V, 15 V, 20 V, or higher. These values of Vin, in some examples, can cause irreversible damage to devices having gate oxide rated at about 5 V, thereby degrading and/or disabling operation of a system, such as the system 100, in which the devices are implemented. However, support for these values of Vin is desired in some examples to extend (e.g., enlarge) operational ranges of the system 100. To protect devices that can be damaged by these high voltages of Vin (e.g., voltages that exceed the gate oxide voltage ratings of the devices), the SVR circuit 110 includes the high voltage protection sub-circuit 125 that protects devices of the SVR circuit 110 from the high voltage Vin.

In at least some examples, to facilitate robust and/or fast start-up of the SVR circuit 110, and thereby provision of power to the load 105 from the voltage source 115, as discussed herein, the node initialization sub-circuit 120 pre-charges and/or initializes one or more nodes (not shown) of the SVR circuit 110. For example, during a start-up process of the SVR circuit 110, the node initialization sub-circuit 120 provides one or more bias currents to nodes of the SVR circuit 110 from alternative sources than will provide the bias currents to the nodes after the SVR circuit 110 has fully started-up and all (or substantially all) aspects of the SVR circuit 110 are capable of operation.

When Vin changes rapidly (e.g., line transients alter the value of Vin, for example, by increasing Vin rapidly, such as by about 1 V/μs), in some examples, it is advantageous for the SVR circuit 110 to rapidly respond to these changes. For example, the fast turn-off sub-circuit 130 rapidly turns off the PMOS path to prevent Vout from exceeding a desired value based on slow response of the PMOS devices of the PMOS path in the presence of an increase in Vin Similarly, when the SVR circuit 110 starts-up from a powered-off state, or when Vin changes rapidly (e.g., line transients alter the value of Vin, for example, by decreasing Vin rapidly, such as by about 1 V/μs), in some examples, it is advantageous for the SVR circuit 110 to rapidly respond to these changes. For example, the fast start-up sub-circuit 135 rapidly turns on the PMOS path to prevent Vout from decreasing below a desired value (e.g., dipping) based on slow response of the PMOS devices of the PMOS path in the presence of a decrease in Vin.

Figure 2A:
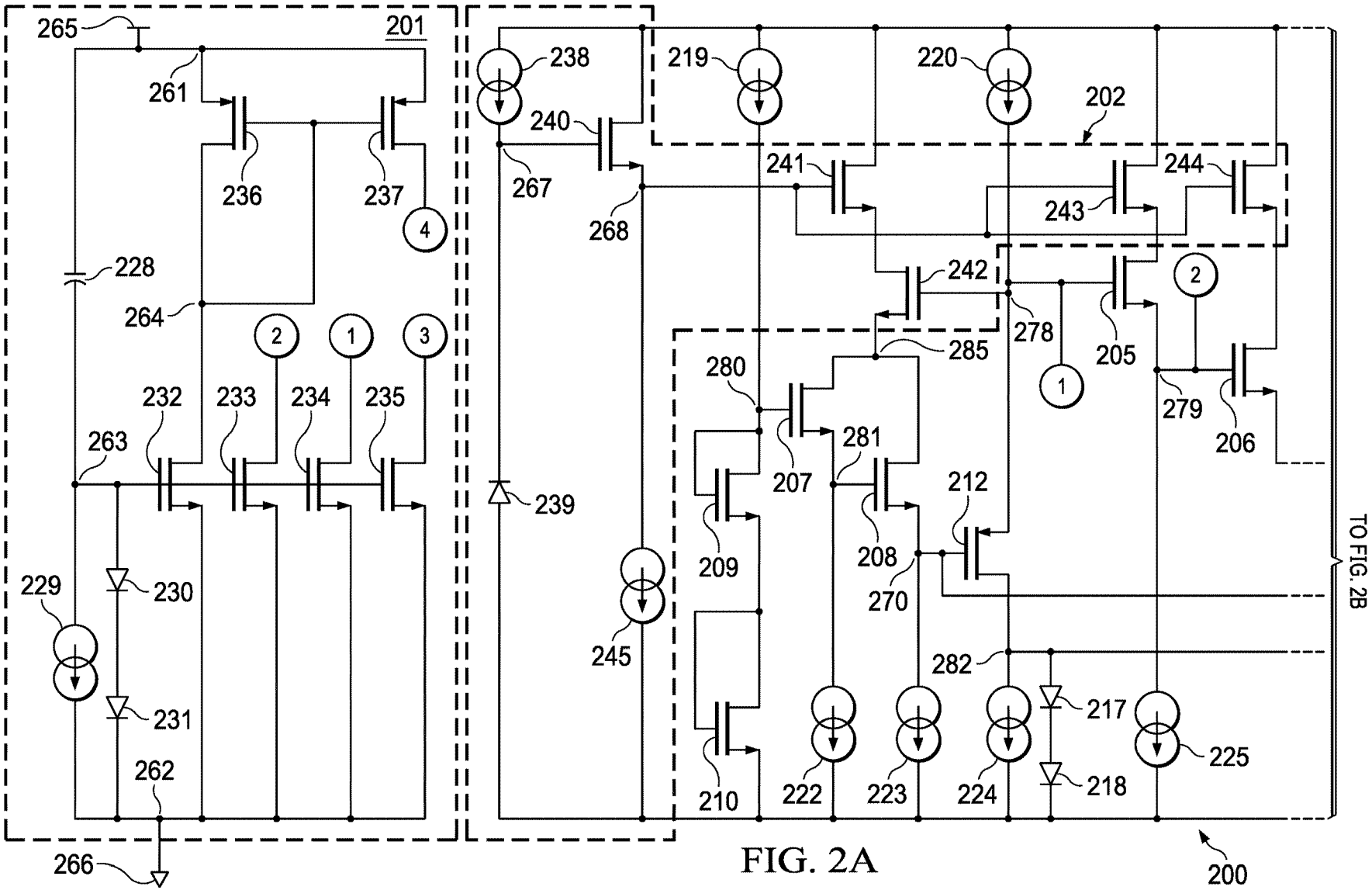
FIG. 2A shows a schematic diagram of an illustrative circuit in accordance with various examples.
Figure 2B:
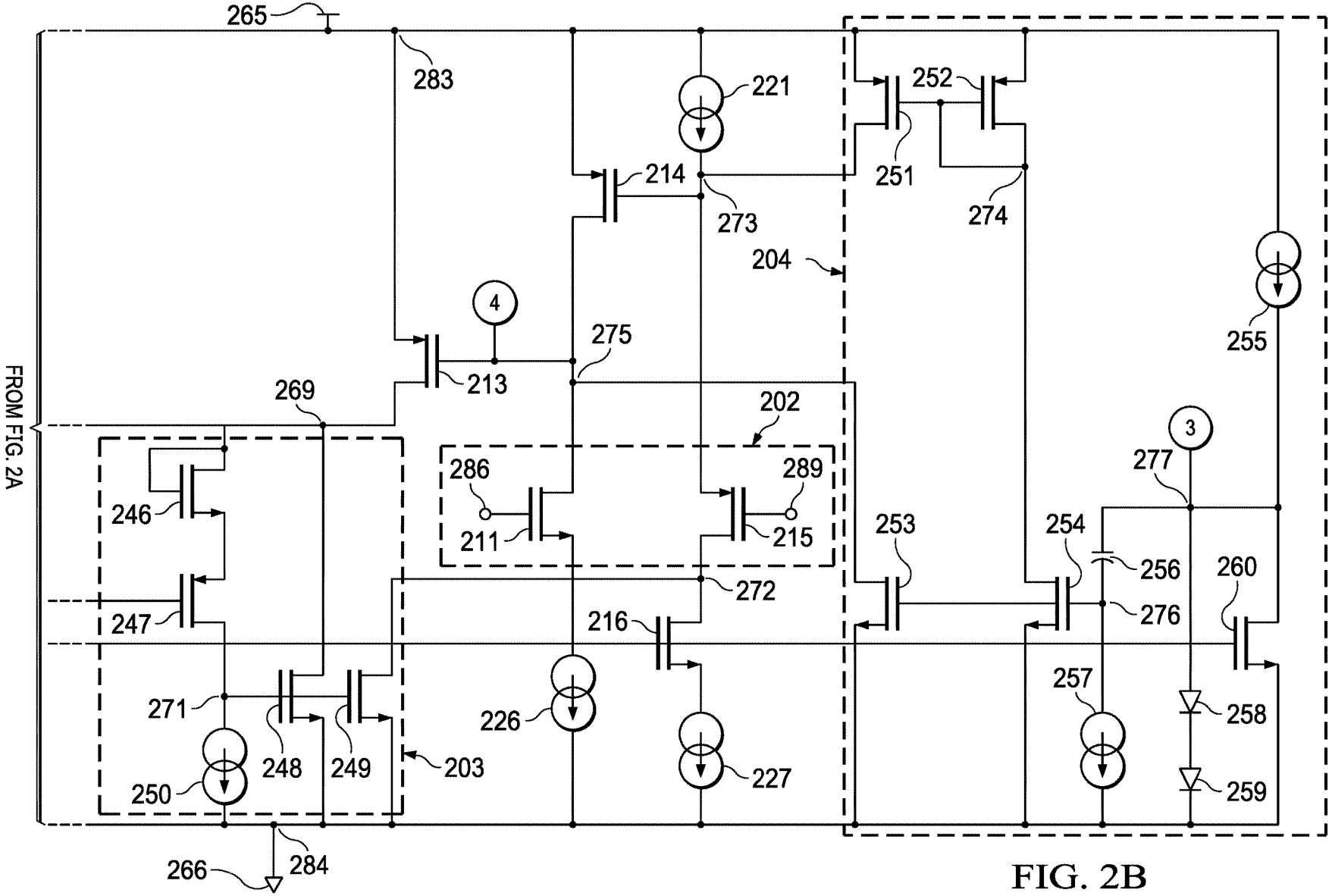
FIG. 2B shows a schematic diagram of an illustrative circuit in accordance with various examples.

Turning now to FIG. 2A and FIG. 2B, a schematic diagram of an illustrative SVR circuit 200 is shown. In at least some examples, the SVR circuit 200 is suitable for implementation as the SVR circuit 110 of the system 100 of FIG. 1, discussed above. In at least some examples, the SVR circuit 200 includes a node initialization sub-circuit 201, a high voltage protection sub-circuit 202, a fast turn-off sub-circuit 203, and a fast start-up sub-circuit 204, each of which may be substantially similar to the node initialization sub-circuit 120, the high voltage protection sub-circuit 125, the fast turn-off sub-circuit 130, and the fast start-up sub-circuit 135, respectively, each of FIG. 1 and discussed above. In at least some examples, the SVR circuit 200 further includes a NMOS 205, a NMOS 206, a NMOS 207, a NMOS 208, a NMOS 209, a NMOS 210, a PMOS 212, a PMOS 213, a PMOS 214, a NMOS 216, a diode 217, a diode 218, and current sources 219, 220, 221, 222, 223, 224, 225, 226, and 227 at least some of which collectively form a control sub-circuit (not shown).

In at least some examples, the node initialization sub-circuit 201 includes a capacitor 228, a current source 229, a diode 230, a diode 231, a NMOS 232, a NMOS 233, a NMOS 234, a NMOS 235, a PMOS 236, and a PMOS 237. In at least some examples, the high voltage protection sub-circuit 202 includes a current source 238, a Zener diode 239, a NMOS 211, a PMOS 215, a NMOS 240, a NMOS 241, a NMOS 242, a NMOS 243, a NMOS 244, and a current source 245. In at least some examples, the fast turn-off sub-circuit 203 includes a NMOS 246, a PMOS 247, a NMOS 248, a NMOS 249, and a current source 250. In at least some examples, the fast start-up sub-circuit 204 includes a PMOS 251, a PMOS 252, a NMOS 253, a NMOS 254, a current source 255, a capacitor 256, a current source 257, a diode 258, a diode 259, and a NMOS 260.

In at least some example architectures of the node initialization sub-circuit 201, the capacitor 228 is coupled between a node 261 and a node 263 and the current source 229 is coupled between the node 263 and a node 262. The diode 230 and the diode 231 are coupled in series between the node 263 and the node 262. The NMOS 232 has a gate terminal coupled to the node 263, a drain terminal coupled to a node 269, and a source terminal coupled to the node 262. The NMOS 233 has a gate terminal coupled to the node 263, a drain terminal coupled to a node 278, and a source terminal coupled to the node 262. The NMOS 234 has a drain gate terminal coupled to the node 263, a drain terminal coupled to a node 279, and a source terminal coupled to the node 262. The NMOS 235 has a gate terminal coupled to the node 263, a drain terminal coupled to a node 277, and a source terminal coupled to the node 262. The PMOS 236 has a gate terminal coupled to the node 264, a drain terminal coupled to the node 264, and a source terminal coupled to the node 261. The PMOS 237 has a gate terminal coupled to the node 264, a drain terminal coupled to a node 275, and a source terminal coupled to the node 261. In at least some examples, the node 261 is configured to couple to a voltage source 265 and the node 262 is configured to couple to a ground potential 266. In at least some examples, node 269 is an output node (e.g., at which Vout is provided) of the SVR circuit 200.

In at least some example architectures of the high voltage protection sub-circuit 202, the current source 238 is coupled between a node 283 and a node 267 and the Zener diode 239 is coupled between the node 267 and a node 284, where a cathode of the Zener diode 239 is coupled to the node 267. The NMOS 211 has a gate terminal coupled to a node 286, a drain terminal coupled to the node 275, and a source terminal. The PMOS 215 has a gate terminal coupled to a node 287, a drain terminal coupled to the node 272, and a source terminal coupled to the node 273. The NMOS 240 has a gate terminal coupled to the node 267, a drain terminal coupled to the node 283, and a source terminal coupled to a node 268. The NMOS 241 has a gate terminal coupled to the node 268, a drain terminal coupled to the node 283, and a source terminal coupled to a drain terminal of the NMOS 242, which has a gate terminal coupled to a node 278 and a source terminal coupled to a node 285. The NMOS 243 has a gate terminal coupled to the node 268, a drain terminal coupled to the node 283, and a source terminal. The NMOS 244 has a gate terminal coupled to the node 268, a drain terminal coupled to the node 283, and a source terminal. The current source 245 is coupled between the node 268 and the node 284. In at least some examples, the node 283 is configured to couple to the voltage source 265 and the node 284 is configured to couple to the ground potential 266.

In at least some example architectures of fast turn-off sub-circuit 203, the NMOS 246 has a gate terminal and a drain terminal coupled to a node 269 and a source terminal coupled to a source terminal of the PMOS 247. The PMOS 247 further has a gate terminal coupled to a node 270 and a drain terminal coupled to a node 271. The NMOS 248 has a gate terminal coupled to the node 271, a drain terminal coupled to the node 269, and a source terminal coupled to the node 284. The NMOS 249 has a gate terminal coupled to the node 271, a drain terminal coupled to a node 272, and a source terminal coupled to the node 284. The current source 250 is coupled between the node 271 and the node 284.

In at least some example architectures of the fast start-up sub-circuit 204, the PMOS 251 has a gate terminal coupled to a node 274, a drain terminal coupled to a node 273, and a source terminal coupled to the node 283. The PMOS 252 has a gate terminal and a drain terminal coupled to the node 274 and a source terminal coupled to the node 283. The NMOS 253 has a gate terminal coupled to a node 276, a drain terminal coupled to the node 275, and a source terminal coupled to the node 284. The NMOS 254 has a gate terminal coupled to the node 276, a drain terminal coupled to the node 274, and a source terminal coupled to the node 284. The current source 255 is coupled between the node 283 and the node 277, the capacitor 256 is coupled between the node 277 and the node 276, and the current source 257 is coupled between the node 276 and the node 284. The diode 258 and the diode 259 are coupled in series between the node 277 and the node 284. The NMOS 260 has a gate terminal coupled to a node 282, a drain terminal coupled to the node 277, and a source terminal coupled to the node 284.

In at least some example architectures, the NMOS 205 has a gate terminal coupled to the node 278, a drain terminal coupled to the source terminal of the NMOS 243, and a source terminal coupled to a node 279. The NMOS 206 has a gate terminal coupled to the node 279, a drain terminal coupled to the source terminal of the NMOS 244, and a source terminal coupled to the node 269. The NMOS 207 has a gate terminal coupled to a node 280, a drain terminal coupled to a node 285, and a source terminal coupled to a node 281. The NMOS 208 has a gate terminal coupled to the node 281, a drain terminal coupled to the node 285, and a source terminal coupled to the node 270. The NMOS 209 has a gate terminal and a drain terminal coupled to the node 280 and a source terminal coupled to a gate terminal and a drain terminal of the NMOS 210 which has a source terminal coupled to the node 284. The PMOS 212 has a gate terminal coupled to the node 270, a drain terminal coupled to the node 282, and a source terminal coupled to the node 278. The PMOS 213 has a gate terminal coupled to the node 275, a drain terminal coupled to the node 269, and a source terminal coupled to the node 283. In at least some examples, the PMOS 213 is implemented as a drain-extended PMOS (DEPMOS) device, while in other examples the PMOS 213 is implemented according to any other suitable technology or manufacturing technique. The PMOS 214 has a gate terminal coupled to the node 273, a drain terminal coupled to the node 275, and a source terminal coupled to the node 283. The NMOS 216 has a gate terminal coupled to the node 282, a drain terminal coupled to the node 272, and a source terminal. The diode 217 and the diode 218 are coupled in series between the node 282 and the node 284. The current source 219 is coupled between the node 283 and the node 280. The current source 220 is coupled between the node 283 and the node 278. The current source 221 is coupled between the node 283 and the node 273. The current source 222 is coupled between the node 281 and the node 284. The current source 223 is coupled between the node 270 and the node 284. The current source 224 is coupled between the node 282 and the node 284. The current source 225 is coupled between the node 279 and the node 284. The current source 226 is coupled between the source terminal of the NMOS 211 and the node 284. The current source 227 is coupled between the source terminal of the NMOS 216 and the node 284.

In at least one example of operation of the node initialization sub-circuit 201, during power-up or start-up of the SVR circuit 200 Vin can couple onto (e.g., be provided to) the node 269 for provision by the SVR circuit 200 as Vout prior to one or more bias currents of the SVR circuit 200 having fully started-up and providing signals at their desired and/or intended value. In such examples, the NMOS 206 and/or PMOS 213 may not be strongly turned-on (e.g., conduction between source and drain terminals may be weak) and, in some circumstances, can trigger a PoR circuit (not shown, but such as may be implemented by, or in, the load 105), falsely indicating an under-voltage or over-voltage condition of the SVR circuit 200. For example, in some examples of the SVR circuit 200 in the absence of the node initialization sub-circuit 201, on start-up of the SVR circuit 200, a value present at the drain terminal of the NMOS 206 follows Vin and the voltage present at the drain terminal of the NMOS 206 couples to the gate terminal of the NMOS 206, turning the NMOS 206 on such that it conducts between its source and drain terminals and provides an unintended value at node 269. In another example also in the absence of the node initialization sub-circuit 201, as Vin increases rapidly (e.g., such as at a rate of 1 V/μs), capacitive division (such as among gate-to-source capacitance, gate-to-drain capacitance, and a capacitance of a load coupled to the node 269) occurs at the PMOS 213, causing a gate-to-source voltage at the PMOS 213 sufficient to turn on the PMOS 213 such that a signal having an unintended value is again provided at node 269.

To mitigate against this false error trigger, the node initialization sub-circuit 201 initializes a plurality of nodes in the SVR circuit 200 to maintain the NMOS 206 and the PMOS 213 in known, controlled states until bias current sources of the SVR circuit 200 have fully started-up and are providing bias current signals. For example, when the SVR circuit 200 powers-up, the capacitor 228 couples a voltage present at node 261 to the node 263 and the voltage at node 263 is clamped to a value (e.g., such as a value less than about 2 V) that is the sum of voltage drops (e.g., about 0.7 V each) across the diode 230 and the diode 231. The diode 230 and the diode 231 clamping the value of the signal present at node 263, in at least some examples, protects the gate terminals of the NMOS 232, NMOS 233, NMOS 234, and NMOS 235 against damage from high-voltage Vin values. The NMOS 232, NMOS 233, NMOS 234, and NMOS 235 turn on based on gate-to-source voltage differentials caused by the signal at node 263, pulling nodes 264, 278, 279, and 277, respectively, to the ground potential 266. Similarly, the PMOS 236 and PMOS 237 turn on, pulling node 275 to the voltage source 265. When the current source 229 has fully started-up, the current source 229 pulls the node 263 to ground, turning off the NMOS 232, NMOS 233, NMOS 234, NMOS 235, PMOS 236, and PMOS 237 as the remainder of the SVR circuit 200 continues to operate unaffected.

Figure 3:
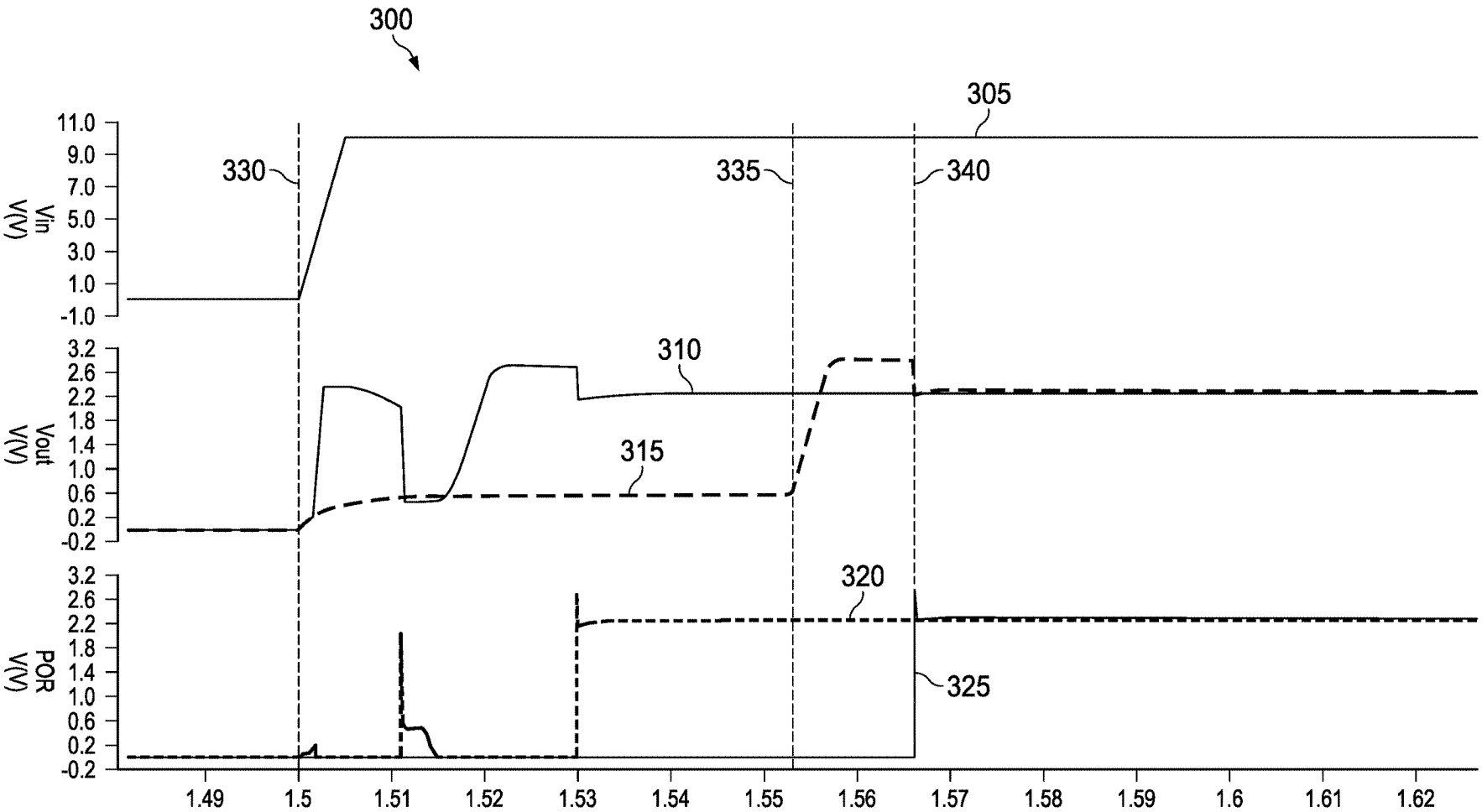
FIG. 3 shows a timing diagram of illustrative waveforms in accordance with various examples.

Turning now to FIG. 3, a diagram 300 of illustrative waveforms of the SVR circuit 200 is shown. As shown in diagram 300, the horizontal axis represents time in milliseconds (ms) and each vertical axis represents voltage in V. The waveform 305 represents Vin, for example, as provided by the voltage source 265 at node 261 of the node initialization sub-circuit 201. The waveform 310 represents Vout of the SVR circuit 200 in the absence of the node initialization sub-circuit 201. The waveform 315 represents Vout of the SVR circuit 200 in the presence of the node initialization sub-circuit 201. The waveform 320 represents an output of a PoR circuit in the absence of the node initialization sub-circuit 201. The waveform 325 represents the output of the PoR circuit in the presence of the node initialization sub-circuit 201

As shown in diagram 300 by the waveform 310, in the absence of the node initialization sub-circuit 201, at a time 330 when the SVR circuit 200 turns-on and Vin increases, in the absence of the node initialization sub-circuit 201 Vout experiences a rapid spike in value followed by a rapid decrease in value (e.g., attributable to actions of the PMOS 213 in the absence of the node initialization sub-circuit 201, as discussed above). Vout subsequently experiences a second rapid spike in value followed by a smaller decrease in value to an intended output value of the SVR circuit 200 (e.g., attributable to actions of the NMOS 206 in the absence of the node initialization sub-circuit 201, as discussed above). As further shown by the waveform 320, POR goes high about 10 μs after Vout goes high. In at least some examples, POR operates as an enable signal for other elements (not shown) of the load 105. When POR goes high, it enables elements of the load 105 such as digital one-time programmable (OTP) memory blocks, bandgap circuits, etc. which can draw large amounts of current from Vout. In some examples this can cause Vout to decrease rapidly. When Vout decreases, POR goes low within a short time, causing toggling of other blocks in the load 105 and detrimentally affecting operation of the load 105. In contrast, as shown by the waveform 315, in the presence of the node initialization sub-circuit 201, at time 330 the node initialization sub-circuit 201 initializes nodes of the SVR circuit 200 until time 335 at which the current source 229 has fully started-up and initialization is no longer needed. Subsequently, at time 340, a remainder of the SVR circuit 200 becomes fully operational (e.g., remainder of SVR circuit 200 turns-on).

Returning to FIG. 2A and FIG. 2B, in at least one example of operation of the high voltage protection sub-circuit 202, Vin (e.g., as provided by the voltage source 265 and present at the node 284) has a voltage having a value in a range that includes at least some voltage values that have a potential to damage one or more elements of the SVR circuit 200 (e.g., such as at least the NMOS 205, NMOS 206, and/or the PMOS 213). For example, the high voltage protection sub-circuit 202 limits maximum voltages present at the drain terminals of the NMOS 205 and the NMOS 206 to about 6 V to protect the NMOS 205 and the NMOS 206 from damage resulting from high voltages (e.g., such as 10 V or more) being present at the drain terminals of the NMOS 205 and the NMOS 206. In such examples, the NMOS 243 operates as a protection transistor for the NMOS 205 and the NMOS 244 operates as a protection transistor for the NMOS 206, protecting drain terminals of the NMOS 205 and the NMOS 206, respectively, from being coupled directly to the node 283 and voltage source 265. The Zener diode 239 clamps a voltage present at the node 267 such that the voltage present at the node 267 does not exceed, approximately, a breakdown voltage of the Zener diode 239 (such as, in some examples, about 6 V) and the NMOS 240 operates in a source-follower configuration to bias the NMOS 241, NMOS 243, and NMOS 244, transferring the voltage present at node 267 to node 268 and the drain terminals of the NMOS 205 and the NMOS 206. The NMOS 211 and the PMOS 215 provide further protection (e.g., for the PMOS 213). In at least some examples, the NMOS 211 and the PMOS 215 receive bias signals (e.g., at node 286 and node 287, respectively) having a value of approximately Vin/2. In at least some examples, the bias signals are generated by any suitable means, including at least generated by a voltage divider.

In at least one example of operation of the fast turn-off sub-circuit 203, one or more bias currents present in the SVR circuit 200 have values of less than about 10 nA. In such examples, turning off of the PMOS 213 (e.g., such that the PMOS 213 does not conduct current between its source and drain terminals) is comparatively slow (e.g., when compared to circuits in which bias currents have values greater than 10 nA). The NMOS 207, NMOS 208, NMOS 209, NMOS 210, and PMOS 212 in at least some examples, form a diode stack. When Vin has a low value (e.g., less than about 2.5 V), node 282 is pulled to ground potential 266 by the current source 224. At higher supply voltages (e.g., greater than about 2.5 V), the diode stack of NMOS 217, NMOS 208, NMOS 209, NMOS 210, and PMOS 212 turns on and current comparison is performed at node 282 between the current source 224 and the current source 220. In at least some examples, the current source 220 has a higher value and therefore pulls node 282 high to Vin. As Vin increases from the low value to the higher value, the PMOS 213 will slowly turn off, as discussed above, allowing the PMOS 213 to pass a signal to node 269 having a value greater than desired (e.g., creating an unintended and/or undesired spike in Vout) until the PMOS 213 fully turns off.

To mitigate against this slow turn-off of the PMOS 213 and spike in Vout, the NMOS 246 and PMOS 247 of the fast turn-off sub-circuit 203 form a second diode stack configured to turn on in the presence of a signal at node 270 having a value greater than, but near, Vout, creating a voltage clamp (e.g., having a value of about 4 V) at node 269. When Vout exceeds the voltage clamp at node 269 and Vin has the higher value, the node 271 is pulled high to approximately a value of Vout minus a gate-to-source voltage of the NMOS 246, turning on the NMOS 248 and the NMOS 249 and rapidly pulling the node 272 to the ground potential 266. When the node 272 is pulled to the ground potential 266, the PMOS 214 turns on, pulling the node 275 to Vin and turning off the PMOS 213 to prevent and/or mitigate the unwanted spike in Vout.

Figure 4:
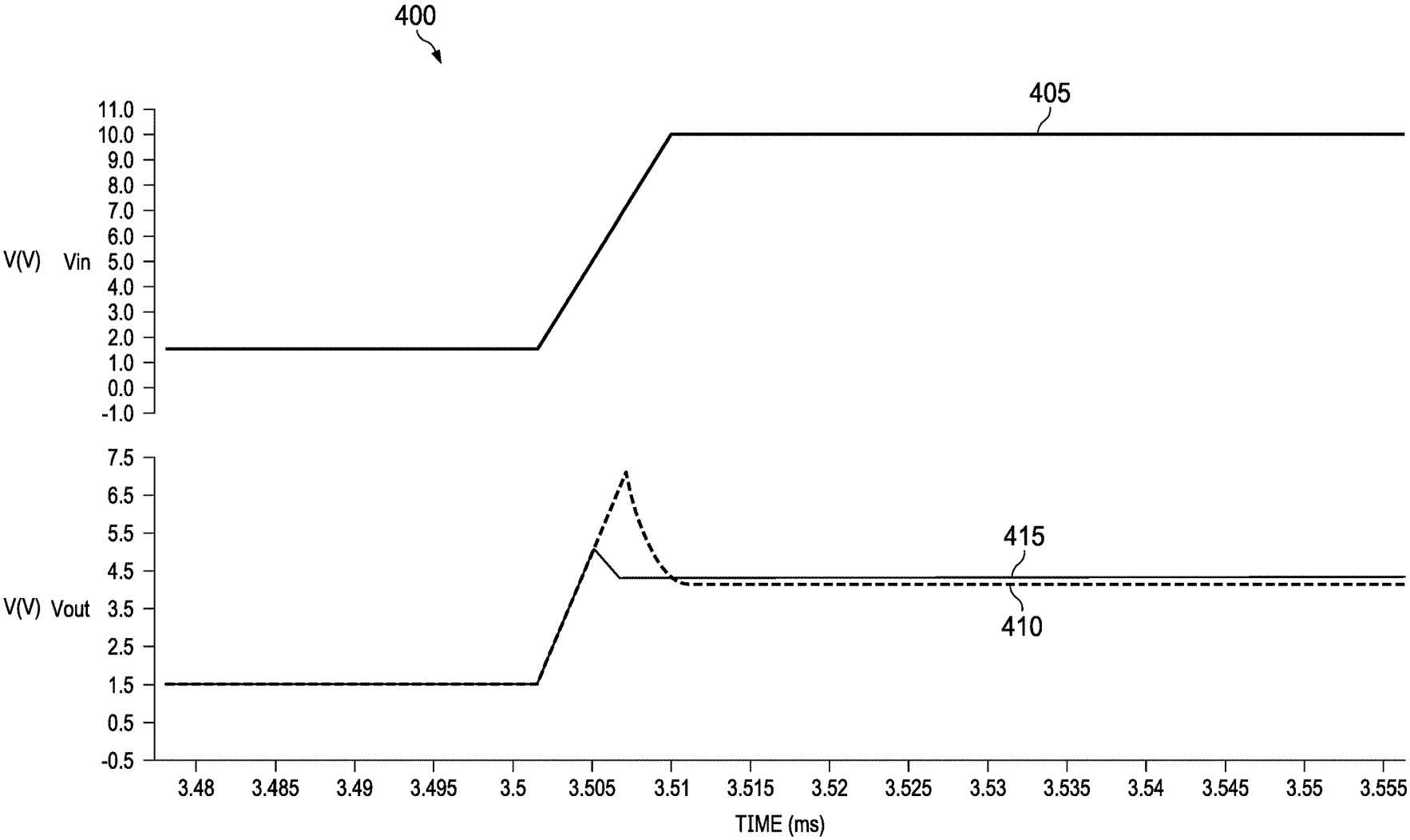
FIG. 4 shows a timing diagram of illustrative waveforms in accordance with various examples.

Turning now to FIG. 4, a diagram 400 of illustrative waveforms of the SVR circuit 200 is shown. As shown in diagram 400, the horizontal axis represents time in milliseconds (ms) and each vertical axis represents voltage in V. The waveform 405 represents Vin, for example, as provided by the voltage source 265 at node 283. The waveform 410 represents Vout of the SVR circuit 200 in the absence of the fast turn-off sub-circuit 203. The waveform 415 represents Vout of the SVR circuit 200 in the presence of the fast turn-off sub-circuit 203.

As shown in diagram 400 by the waveform 410, in the absence of the fast turn-off sub-circuit 203, as Vin increases Vout experiences a spike in value. In contrast, as shown by the waveform 415, in the presence of the fast turn-off sub-circuit 203, the spike in Vout is at least partially mitigated.

Returning to FIG. 2A and FIG. 2B, in at least one example of operation of the fast start-up sub-circuit 204 one or more bias currents present in the SVR circuit 200 have values of less than about 10 nA. In such examples, turning on of the PMOS 213 (e.g., such that the PMOS 213 does not conduct current between its source and drain terminals) is comparatively slow (e.g., when compared to circuits in which bias currents have values greater than 10 nA). However, in at least some examples, it may be beneficial and/or desired for the PMOS 213 to very rapidly turn on. For example, in some implementations of the SVR circuit 200, a design specification of the SVR circuit 200 may dictate a particular start-up time for the SVR circuit 200 and/or one or more components of the SVR circuit 200, such as, for example, less than about 200 μs or less than about 100 μs. In such examples, to meet the start-up time for the SVR circuit 200 the fast start-up sub-circuit 204 controls the PMOS 213 to rapidly turn on the PMOS 213. In another example, during operation of the PMOS 213 Vin may rapidly decrease from the high value, as discussed above, to the low value, also as discussed above. In such circumstances, Vout may dip below a desired and/or intended value if the PMOS 213 turns on slowly. To mitigate the dip in Vout as Vin rapidly decreases in value, in at least some examples, the fast start-up sub-circuit 204 controls the PMOS 213 to rapidly turn on the PMOS 213.

In at least some examples, node 282 controls operation of the PMOS 213. For example, when a signal is present at the node 282 with a low value (e.g., a value sufficient to turn on the PMOS 213), the PMOS 213 is turned-on and when a signal is present at the node 282 with a high value (e.g., a value sufficient to turn off the PMOS 213 and/or prevent the PMOS 213 from turning-on), the PMOS 213 is turned-off. During start-up of the SVR circuit 200 (e.g., such as during a time in which the node initialization sub-circuit 201 is providing a signal to nodes of the SVR circuit 200 while bias currents of the SVR circuit 200 are brought to full value, as discussed above) and/or when Vin rapidly decreases in value (e.g., such as at a rate of about 1 V/μs), the node 282 is pulled to the ground potential 266 by the current source 224. When the node 282 is pulled to the ground potential 266, the NMOS 260 turns off and the current source 255 rapidly charges the node 277, increasing the value of a signal present at the node 277. The signal present at node 277 is coupled to node 276 by the capacitor 256, turning on the NMOS 253 and the NMOS 254. When turned-on, the NMOS 253 pulls the node 275 to the ground potential 266, turning on the PMOS 213 and the NMOS 254 pulls the node 274 to the ground potential 266, turning on the PMOS 251 and the PMOS 252 and pulling the node 273 to Vin, turning off the PMOS 214. After a period of time, the current source 257 pulls the node 276 to the ground potential 266, turning off the NMOS 253 and the NMOS 254, and thereby disabling the fast start-up sub-circuit 204. In at least some examples, a current ratio of current signals provided by the current source 255 and the current source 257 is approximately twelve-to-one.

Figure 5:
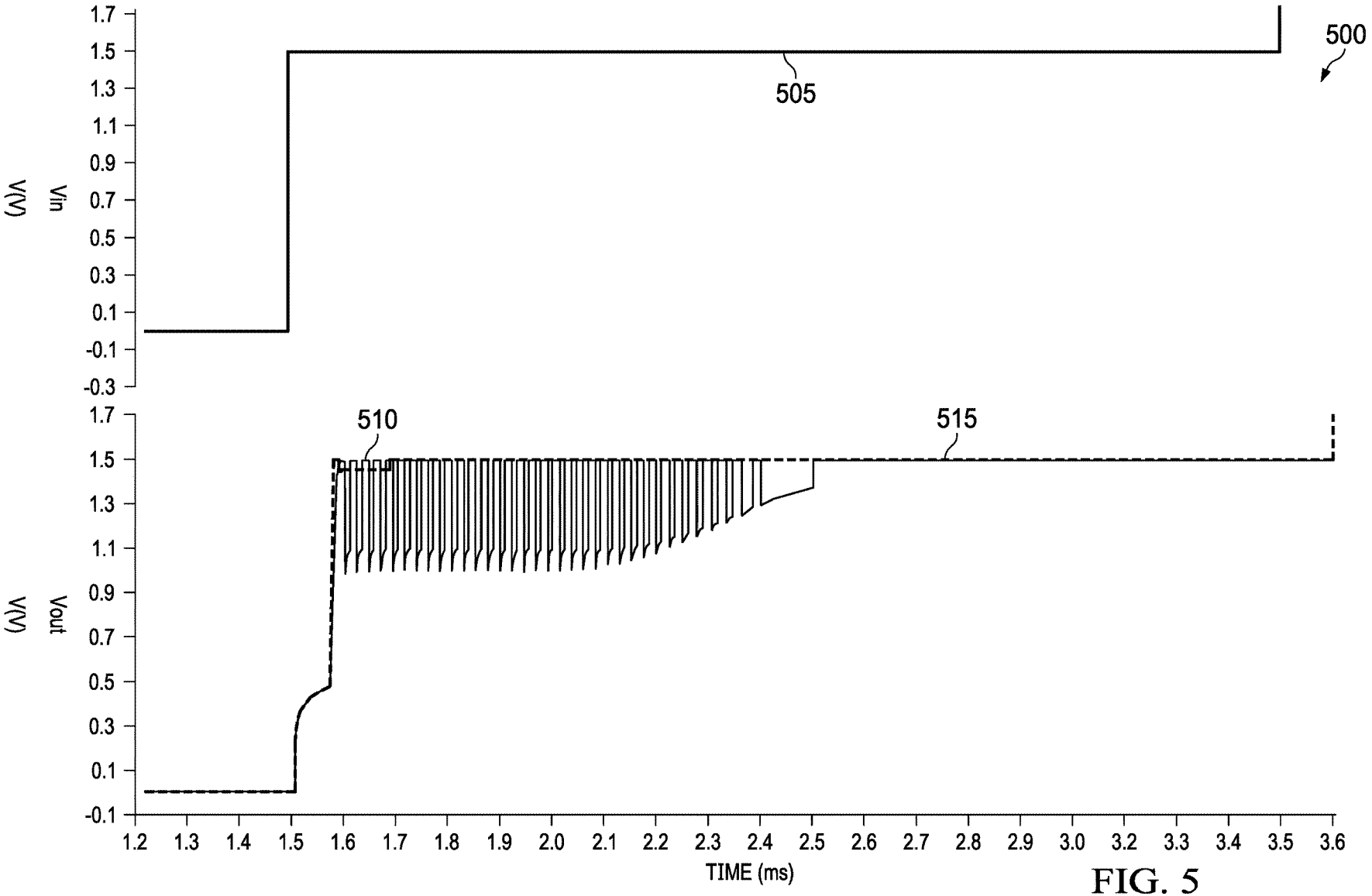
FIG. 5 shows a timing diagram of illustrative waveforms in accordance with various examples.

Turning now to FIG. 5, a diagram 500 of illustrative waveforms of the SVR circuit 200 is shown. As shown in diagram 500, the horizontal axis represents time in milliseconds (ms) and each vertical axis represents voltage in V. The waveform 505 represents Vin, for example, as provided by the voltage source 265 at node 283. The waveform 510 represents Vout of the SVR circuit 200 in the absence of the fast start-up sub-circuit 204. The waveform 515 represents Vout of the SVR circuit 200 in the presence of the fast start-up sub-circuit 204.

As shown in diagram 500 by the waveform 510, in the absence of the fast start-up sub-circuit 204, as Vin increases during start-up of the SVR circuit 200, a value of Vout experiences ringing, rapidly increasing and decreasing in value for a period of time. The ringing is caused, in at least some examples, by the slow response of PMOS 213 due to low value bias currents and the absence of the fast start-up sub-circuit 204. In contrast, as shown by the waveform 515, in the presence of the fast start-up sub-circuit 204, the ringing in Vout is at least partially mitigated and the SVR circuit 200. starts-up (e.g., delivering a consistent Vout) more quickly than in the absence of the fast start-up sub-circuit 204.

Figure 6:
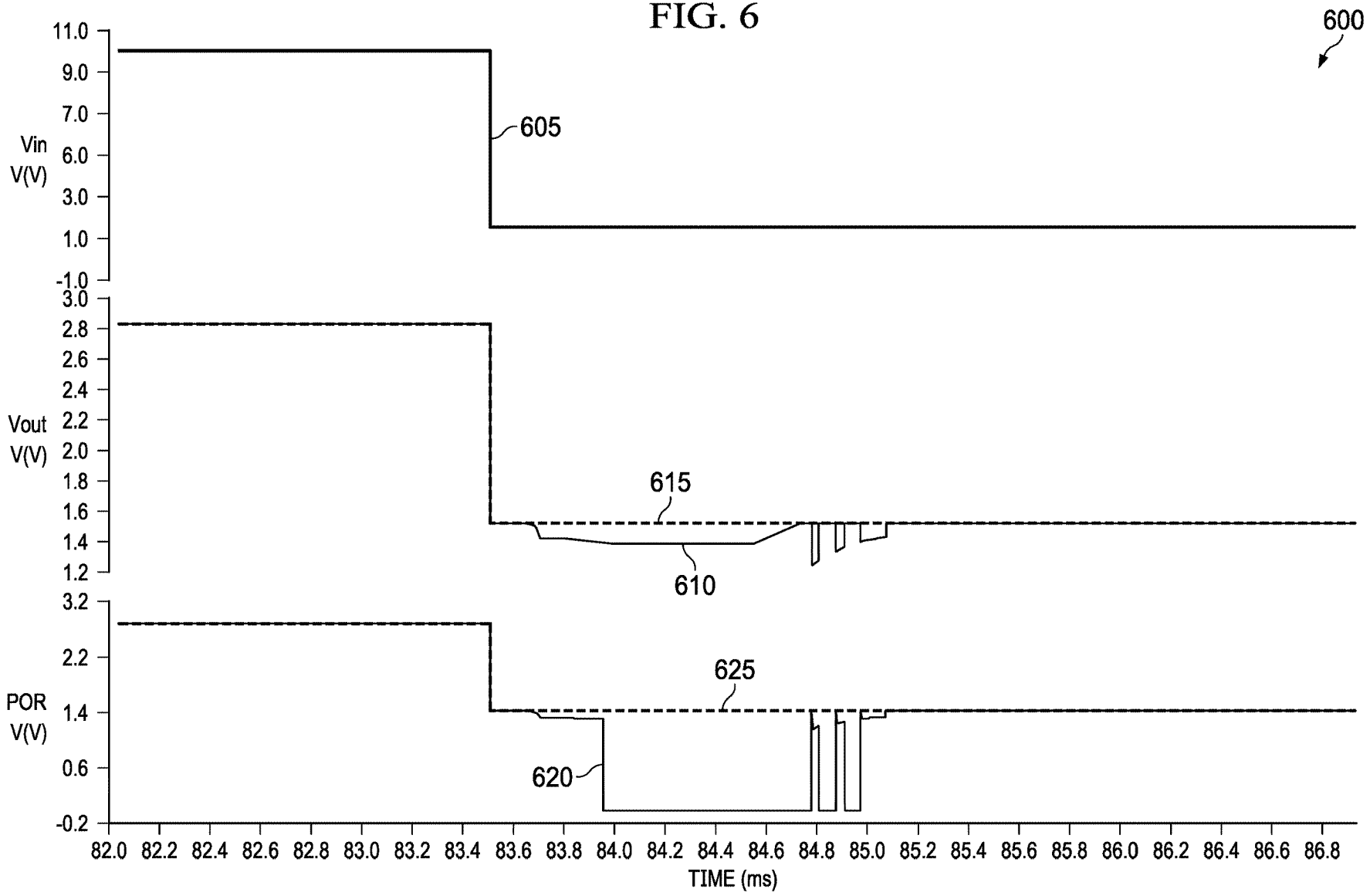
FIG. 6 shows a timing diagram of illustrative waveforms in accordance with various examples.

Turning now to FIG. 6, a diagram 600 of illustrative waveforms of the SVR circuit 200 is shown. As shown in diagram 600, the horizontal axis represents time in milliseconds (ms) and each vertical axis represents voltage in V. The waveform 605 represents Vin, for example, as provided by the voltage source 265 at node 283. The waveform 610 represents Vout of the SVR circuit 200 in the absence of the fast start-up sub-circuit 204. The waveform 615 represents Vout of the SVR circuit 200 in the presence of the fast start-up sub-circuit 204. The waveform 620 represents an output of a PoR circuit in the absence of the fast start-up sub-circuit 204. The waveform 625 represents the output of the PoR circuit in the presence of the fast start-up sub-circuit 204.

As shown in diagram 600 by the waveform 610, in the absence of the fast start-up sub-circuit 204, when Vin decreases rapidly in value, a value of Vout experiences ringing, increasing and decreasing in value for a period of time. As further shown by the waveform 620, the false PoR ringing causes related ringing of Vout. In contrast, as shown by the waveform 615, in the presence of the fast start-up sub-circuit 204, Vout drops and remains consistent, not causing false PoR triggers, as shown by waveform 625.

In the foregoing discussion, the various current sources and/or bias currents may be implemented by any suitable means, the scope of which is not limited herein. In at least some examples, each current source described herein may be a separate, independent component. In other examples, one or more of the current sources disclosed herein may be a mirrored copy (e.g., via a current mirror) of a generated bias current, for example, such that one generated bias current is mirrored a plurality of times by a plurality of respective current mirrors to function as the respective current sources disclosed herein. In at least some examples, the various current sources of the present disclosures bias one or more devices and/or nodes to cause current to flow through circuits in a given direction, pulling one or more devices and/or nodes high to approximately a value of Vin or low to approximately a value of the ground voltage potential, or biasing a MOSFET device to cause the MOSFET device to conduct or not conduct current between its respective source and drain terminals.

Additionally, at least some of the devices of the present disclosure may be implemented as natural devices. For example, any one or more of the NMOS 205, NMOS 206, NMOS 207, NMOS 208, NMOS 211, NMOS 240, NMOS 241, NMOS 242, NMOS 243, and/or NMOS 244 may be natural NMOS devices. In various examples, at least some devices of the present disclosure may instead be implemented as depletion devices or as enhancement devices. In yet other examples, at least some devices of the present disclosure may be implemented as drain-extended devices.

Additionally, in the foregoing discussion, the terms "including" and "comprising" are used in an open-ended fashion, and thus should be interpreted to mean "including, but not limited to . . . ." Also, the term "couple" or "couples" is intended to mean either an indirect or direct wired or wireless connection. Thus, if a first device, element, or component couples to a second device, element, or component, that coupling may be through a direct coupling or through an indirect coupling via other devices, elements, or components and connections. Similarly, a device, element, or component that is coupled between a first component or location and a second component or location may be through a direct connection or through an indirect connection via other devices, elements, or components and/or couplings. A device that is "configured to" perform a task or function may be configured (e.g., programmed and/or hardwired) at a time of manufacturing by a manufacturer to perform the function and/or may be configurable (or re-configurable) by a user after manufacturing to perform the function and/or other additional or alternative functions. The configuring may be through firmware and/or software programming of the device, through a construction and/or layout of hardware components and interconnections of the device, or a combination thereof. Furthermore, a circuit or device that is said to include certain components may instead be configured to couple to those components to form the described circuitry or device. For example, a structure described as including one or more semiconductor elements (such as transistors), one or more passive elements (such as resistors, capacitors, and/or inductors), and/or one or more sources (such as voltage and/or current sources) may instead include only the semiconductor elements within a single physical device (e.g., a semiconductor die and/or integrated circuit (IC) package) and may be configured to couple to at least some of the passive elements and/or the sources to form the described structure either at a time of manufacture or after a time of manufacture, for example, by an end-user and/or a third-party.

While certain components are described herein as being of a particular process technology (e.g., field effect transistor (FET), MOSFET, NMOS, PMOS, etc.), these components may be exchanged for components of other process technologies (e.g., replace FET and/or MOSFET with bi-polar junction transistor (BJT), replace n-type with p-type or vice versa, etc.) and reconfiguring circuits including the replaced components to provide desired functionality at least partially similar to functionality available prior to the component replacement. Components illustrated as resistors, unless otherwise stated, are generally representative of any one or more elements coupled in series and/or parallel to provide an amount of impedance represented by the illustrated resistor. Additionally, uses of the phrase "ground voltage potential" in the foregoing discussion are intended to include a chassis ground, an Earth ground, a floating ground, a virtual ground, a digital ground, a common ground, and/or any other form of ground connection applicable to, or suitable for, the teachings of the present disclosure. Unless otherwise stated, "about", "approximately", or "substantially" preceding a value means+/−10 percent of the stated value.

The above discussion is meant to be illustrative of the principles and various examples of the present disclosure. Numerous variations and modifications will become apparent to those skilled in the art once the above disclosure is fully appreciated. It is intended that the present disclosure be interpreted to embrace all such variations and modifications.

What is claimed is:

1. A circuit comprising:

a control sub-circuit comprising:

a first transistor having a first gate, a first drain, and a first source;

a second transistor having a second gate, a second drain, and a second source, the second gate coupled to the first source;

a third transistor having a third gate, a third drain, and a third source; and a fourth transistor having a fourth gate, a fourth drain, and a fourth source, the fourth gate coupled to the third drain, the fourth source coupled to the third source, and the fourth drain coupled to the second source; and a fast turn-off sub-circuit coupled to the fourth drain.

2. The circuit of claim 1, wherein the fast turn-off sub-circuit is configured to couple the fourth gate to a voltage supply to bypass a bias current turn off of the fourth transistor and rapidly turn off the fourth transistor when an output voltage at the fourth drain exceeds a clamp voltage of the fast turn-off sub-circuit.

3. The circuit of claim 1, further comprising:

a fast turn-on sub-circuit coupled to the third gate, and the fast turn-on sub-circuit configured to turn on the first transistor, the second transistor, the third transistor, or the fourth transistor more rapidly than in the absence of the fast turn-on sub-circuit.

4. The circuit of claim 3, wherein the fast turn-on sub-circuit is configured to couple the fourth gate to a ground voltage to rapidly turn on the fourth transistor for a period of time to bypass a bias current turn on of the fourth transistor to rapidly turn on the fourth transistor.

5. The circuit of claim 1, further comprising:

a voltage protection sub-circuit configured to protect the control sub-circuit from a voltage input signal that exceeds a tolerance of the control sub-circuit.

6. The circuit of claim 1, further comprising:

a node initialization sub-circuit coupled to the first gate, and the node initialization sub-circuit configured to initialize nodes of the circuit.

7. The circuit of claim 6, wherein the control sub-circuit is configured to couple to bias current sources, and wherein the node initialization sub-circuit is configured to initialize the nodes of the control sub-circuit during a start-up period of the bias current sources.

8. The circuit of claim 1, further comprising:

a diode stack coupled to the first gate.

9. The circuit of claim 8, further comprising:

a fifth transistor having a fifth gate, a fifth source, and a fifth drain, the fifth gate coupled to the diode stack.

10. The circuit of claim 9, further comprising:

a sixth transistor having a sixth gate, a sixth source, and a sixth drain, the sixth gate coupled to the fifth drain and the sixth source coupled to the third gate.

11. A circuit comprising:

a control sub-circuit comprising:

a first transistor having a first gate, a first drain, and a first source;

a second transistor having a second gate, a second drain, and a second source, the second gate coupled to the first source;

a third transistor having a third gate, a third drain, and a third source; and a fourth transistor having a fourth gate, a fourth drain, and a fourth source, the fourth gate coupled to the third drain, the fourth drain coupled to the second source, and the fourth source coupled to the third source; and a fast turn-on sub-circuit coupled to the third gate.

12. The circuit of claim 11, wherein the fast turn-on sub-circuit is configured to couple the fourth gate to a ground voltage to rapidly turn on the fourth transistor for a period of time to bypass a bias current turn on of the fourth transistor to rapidly turn on the fourth transistor.

13. The circuit of claim 11, further comprising:

a fast turn-off sub-circuit coupled to the fourth drain, and the fast turn-off sub-circuit configured to turn off the first transistor, the second transistor, the third transistor, or the fourth transistor more rapidly than in the absence of the fast turn-off sub-circuit.

14. The circuit of claim 13, wherein the fast turn-off sub-circuit is configured to couple the fourth gate to a voltage supply to bypass a bias current turn off of the fourth transistor and rapidly turn off the fourth transistor when an output voltage present at the fourth drain exceeds a clamp voltage of the fast turn-off sub-circuit.

15. The circuit of claim 11, further comprising:

a voltage protection sub-circuit configured to protect the control sub-circuit from a voltage input signal that exceeds a tolerance of the control sub-circuit.

16. The circuit of claim 11, further comprising:

a node initialization sub-circuit coupled to the first gate, and the node initialization sub-circuit configured to initialize nodes of the circuit.

17. The circuit of claim 16, wherein the control sub-circuit is configured to couple to bias current sources, and wherein the node initialization sub-circuit is configured to initialize the nodes of the control sub-circuit during a start-up period of the bias current sources.

18. The circuit of claim 11, further comprising:

a diode stack coupled to the first gate.

19. The circuit of claim 18, further comprising:

a fifth transistor having a fifth gate, a fifth drain, and a fifth source, the fifth gate coupled to the diode stack, and a source terminal.

20. The circuit of claim 19, further comprising:

a sixth transistor having a sixth gate, a sixth drain, and a sixth source, the sixth drain coupled to the fifth drain and the sixth source coupled to the third gate.

21. A circuit comprising:

a control sub-circuit comprising:

a first transistor having a first gate, a first drain, and a first source;

a second transistor having a second gate, a second drain, and a second source, the second gate coupled to the first source;

a third transistor having a third gate, a third drain, and a third source; and fourth transistor having a fourth gate, a fourth drain, and a fourth source, the fourth gate coupled to the third drain, the fourth drain coupled to the second source, and the fourth source coupled to the third source;

a voltage protection sub-circuit coupled to the first gate;

a fast turn-off sub-circuit coupled to the fourth drain;

a fast turn-on sub-circuit coupled to the third gate and to the fourth gate; and a node initialization sub-circuit coupled to the first gate, to the second gate, to the third drain, to the fourth gate, and to the fast turn-on sub-circuit.

22. The circuit of claim 21, wherein the voltage protection sub-circuit is configured to protect the control sub-circuit from a voltage input signal that exceeds a tolerance of the control sub-circuit.

23. The circuit of claim 21, wherein the fast turn-off sub-circuit is configured to turn off at least a portion of the control sub-circuit more rapidly than in the absence of the fast turn-off sub-circuit.

24. The circuit of claim 23, wherein the fast turn-off sub-circuit is configured to couple the fourth gate to a voltage supply to bypass a bias current turn off of the fourth transistor and rapidly turn off the fourth transistor when an output voltage present at the fourth drain exceeds a clamp voltage of the fast turn-off sub-circuit.

25. The circuit of claim 23, wherein the fast turn-on sub-circuit is configured to turn on at least the portion of the control sub-circuit more rapidly than in the absence of the fast turn-on sub-circuit.

26. The circuit of claim 25, wherein the fast turn-on sub-circuit is configured to couple the fourth gate to a ground voltage potential to rapidly turn on the fourth transistor for a period of time to bypass a bias current turn on of the fourth transistor to rapidly turn on the fourth transistor.

27. The circuit of claim 21, wherein the control sub-circuit is configured to couple to bias current sources, and wherein the node initialization sub-circuit is configured to initialize nodes of the control sub-circuit during a start-up period of the bias current sources.

28. The circuit of claim 21, further comprising:

a diode stack coupled to the first gate.

29. The circuit of claim 28, further comprising:

a fifth transistor having a fifth gate, a fifth drain, and a fifth source, the fifth gate coupled to the diode stack.

30. The circuit of claim 29, further comprising:

a sixth transistor having a sixth gate, a sixth drain, and a sixth source, the sixth drain coupled to the fifth drain and the sixth source coupled to the third gate.

* * * * *